US012662228B2

(12) United States Patent
Davenport et al.

(10) Patent No.: US 12,662,228 B2
(45) Date of Patent: Jun. 23, 2026

(54) MARINE MOTOR ASSEMBLY AND METHOD FOR CHANGING LUBRICANT IN A MARINE MOTOR ASSEMBLY

(71) Applicant: BRP US Inc., Sturtevant, WI (US)

(72) Inventors: Mike Dean Davenport, Pleasant Prairie, WI (US); Dillon Savage, Waterford, WI (US); John Valek, Burlington, WI (US); Michael James Lavalley, West Allis, WI (US)

(73) Assignee: BRP US Inc.

( * ) Notice: Subject to any disclaimer, the term of this patent is extended or adjusted under 35 U.S.C. 154(b) by 396 days.

(21) Appl. No.: 18/362,053

(22) Filed: Jul. 31, 2023

(65) Prior Publication Data

US 2024/0391577 A1 Nov. 28, 2024

Related U.S. Application Data

(60) Provisional application No. 63/504,123, filed on May 24, 2023.

(51) Int. Cl.
*B63H 23/06* (2006.01)
*B63H 21/38* (2006.01)

(52) U.S. Cl.
CPC ..... *B63H 23/06* (2013.01); *B63H 21/386* (2013.01)

(58) Field of Classification Search
CPC .... B63H 20/00; B63H 20/001; B63H 20/002; B63H 20/32; B63H 2020/323; B63H 21/38; B63H 21/386; B63H 23/00; B63H 23/02; B63H 23/06
USPC ..... 440/76, 78, 88 R, 88 L
See application file for complete search history.

(56) References Cited

U.S. PATENT DOCUMENTS

| | | | | |
|---|---|---|---|---|
| 7,736,206 | B1 | 6/2010 | McChesney et al. | |
| 9,499,247 | B1 | 11/2016 | Wiatrowski et al. | |
| 10,502,312 | B1 * | 12/2019 | Jaszewski | F16H 57/045 |
| 11,180,235 | B2 | 11/2021 | Wiatrowski | |
| 11,572,145 | B1 * | 2/2023 | Andrasko | B63H 20/28 |
| 11,884,374 | B1 * | 1/2024 | Andrasko | B63H 20/002 |
| 12,275,511 | B2 * | 4/2025 | Waldvogel | B63H 20/007 |

* cited by examiner

*Primary Examiner* — Daniel V Venne
(74) *Attorney, Agent, or Firm* — BCF LLP

(57) ABSTRACT

A marine motor assembly for a watercraft includes a housing, a motor, a housing gearset, a gearcase gearset and a propulsion device. The housing includes an upper housing portion and a gearcase connected to the upper housing portion. The gearcase includes a gearcase chamber, and a gearcase fluid port disposed on an exterior surface of the gearcase. The housing also includes a housing chamber spaced from the gearcase chamber, a housing fluid port that is disposed on an exterior surface of the housing and that is fluidly connected to the housing chamber, and a fluid conduit that fluidly connects the gearcase chamber to the housing chamber. The housing gearset is disposed in the housing chamber. The gearcase gearset is disposed in the gearcase chamber. A method for changing a lubricant in the marine motor assembly via the gearcase fluid port and the housing fluid port is also disclosed.

19 Claims, 9 Drawing Sheets

MARINE MOTOR ASSEMBLY AND METHOD FOR CHANGING LUBRICANT IN A MARINE MOTOR ASSEMBLY

CROSS-REFERENCE

The present application claims priority to U.S. Provisional Patent Application No. 63/504,123, filed May 24, 2023 entitled "Marine Motor Assembly and Method for Changing Lubricant in a Marine Motor Assembly", which is incorporated by reference herein in its entirety.

TECHNICAL FIELD

The present technology relates to marine engine assemblies and methods for changing lubricant in marine engine assemblies.

BACKGROUND

A typical marine motor assembly has a motor disposed inside a housing and a gearcase supporting a propeller. The gearcase has a gearset housed therein to transfer the torque from a driveshaft driven by the motor to the propeller. Some marine engine assemblies also have a second gearset that is spaced from the gearset disposed in the gearcase to transfer torque from the motor to the driveshaft. These gearsets require lubrication for proper function of the marine outboard engine.

In some marine engine assemblies, the gearsets are disposed in different chambers. Each of the chambers contains lubricant for lubricating its respective gearset. Replacing the lubricant in such marine engine assemblies can be time-consuming and/or hinder user experience, as it requires a user to perform two separate lubricant replacing operations (i.e., one per chamber).

Therefore, there is a desire for a marine motor assembly that can overcome at least some of the above-described drawbacks

SUMMARY

It is an object of the present technology to ameliorate at least some of the inconveniences present in the prior art.

According to implementations of the present technology, there is provided a marine motor assembly having two gearsets, each one being disposed in a respective chamber. The chambers are spaced from one another and are fluidly connected to one another. Lubricant is present in the chambers for lubricating the gearsets. The present technology enables a user to replace the lubricant in both chambers during a single lubricant replacing operation.

According to one aspect of the present technology, there is provided a marine motor assembly for a watercraft having a housing, a motor, a housing gearset, a gearcase gearset and a propulsion device. The housing includes an upper housing portion, and a gearcase connected to the upper housing portion. The gearcase includes a gearcase chamber, and a gearcase fluid port disposed on an exterior surface of the gearcase. The housing also includes a housing chamber spaced from the gearcase chamber, a housing fluid port that is disposed on an exterior surface of the housing, and that is fluidly connected to the housing chamber, and a fluid conduit fluidly connecting the gearcase chamber to the housing chamber. The motor is disposed in the housing. The housing gearset, which is disposed in the housing chamber, is operatively connected to the motor. The gearcase gearset, which is disposed in the gearcase chamber, is operatively connected to the housing gearset. The propulsion device is operatively connected to the gearcase gearset.

In some embodiments, the housing gearset includes bevel gears.

In some embodiments, the marine motor assembly further includes a driveshaft operatively connecting the housing gearset to the gearcase gearset.

In some embodiments, the motor is an internal combustion engine, and the driveshaft is oriented generally perpendicularly relative to a crankshaft of the internal combustion engine.

In some embodiments, the gearcase gearset includes bevel gears.

In some embodiments, the gearcase gearset includes a first bevel gear, a second bevel gear, and a pinion engaging the first and second pinion bevel gears, the pinion being operatively connected to the housing gearset, and the marine motor assembly further includes a dog-clutch assembly selectively operatively connecting one of the first and second bevel gears to the propulsion device.

In some embodiments, the housing chamber is located vertically above the gearcase chamber.

In some embodiments, the housing chamber is in the upper housing portion.

In some embodiments, the housing fluid port is disposed on the upper housing portion.

In some embodiments, the housing fluid port is disposed on a downward facing surface of the upper housing portion.

In some embodiments, the gearcase fluid port is disposed on a bottom of the gearcase.

In some embodiments, the fluid conduit extends upwardly from the gearcase chamber to the housing chamber.

In some embodiments, the fluid conduit includes a gearcase section and a housing section, the gearcase section being a pipe extending in the gearcase, and the housing section being a channel defined in the upper housing portion.

In some embodiments, the housing chamber includes an inlet fluidly connected to the fluid conduit, and an outlet fluidly connected to the housing fluid port.

In some embodiments, the outlet is fluidly connected to the housing fluid port via a secondary fluid conduit extending generally downwardly from the housing chamber.

In some embodiments, the outlet is disposed vertically higher than a lower edge of all gears of the housing gearset when the marine motor assembly is in a neutral position.

In some embodiments, the outlet is spaced from a top of the housing chamber for providing clearance for a compressible gas.

In some embodiments, the gearcase chamber is fluidly sealed from a rest of the gearcase by a bracket.

In some embodiments, the marine motor assembly further includes a gearcase plug for selectively plugging the gearcase fluid port for preventing flow of fluid therethrough, and a housing plug for selectively plugging the housing fluid port for preventing flow of fluid therethrough.

According to another aspect of the present technology, there is provided a method for changing a lubricant in a marine motor assembly. The method includes draining the lubricant from a gearcase chamber of the marine motor assembly and from a housing chamber of the marine motor assembly via a gearcase fluid port disposed on a housing of the marine motor assembly and via a housing fluid port disposed on the housing of the marine motor assembly. The method also includes pumping replacement lubricant into the gearcase and housing chambers via the gearcase fluid port until at least some of the replacement lubricant flows out of the housing fluid port, where the replacement lubricant flows sequentially into the gearcase chamber for lubricating a gearcase gearset, into a fluid conduit, into the housing chamber for lubricating a housing gearset, and out of the housing fluid port.

For purposes of this application, terms related to spatial orientation such as forward, rearward, upward, downward, left, and right, should be understood in a frame of reference of the marine motor assembly, as it would be mounted to a watercraft in a neutral trim position. Terms related to spatial orientation when describing or referring to components or sub-assemblies of the engine assembly separately therefrom should be understood as they would be understood when these components or sub-assemblies are mounted in the marine motor assembly, unless specified otherwise in this application.

Explanations and/or definitions of terms provided in the present application take precedence over explanations and/or definitions of these or similar terms that may be found in any documents incorporated herein by reference.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiment of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

It should be noted that the Figures are not necessarily drawn to scale.

DETAILED DESCRIPTION

The present technology is described with reference to its use in a marine motor assembly 100 that is used to propel a watercraft and is configured to be disposed under the deck of the watercraft it propels. It is contemplated that the marine motor assembly 100 may be disposed at a transom of a watercraft, but not beneath its deck and that aspects of the present technology could be used in other types of marine engine assemblies, such as in a marine outboard motors having a midsection connected below the engine, a gearcase connected below the midsection, and a transom bracket configured to connect the midsection to a watercraft.

Figure 1:
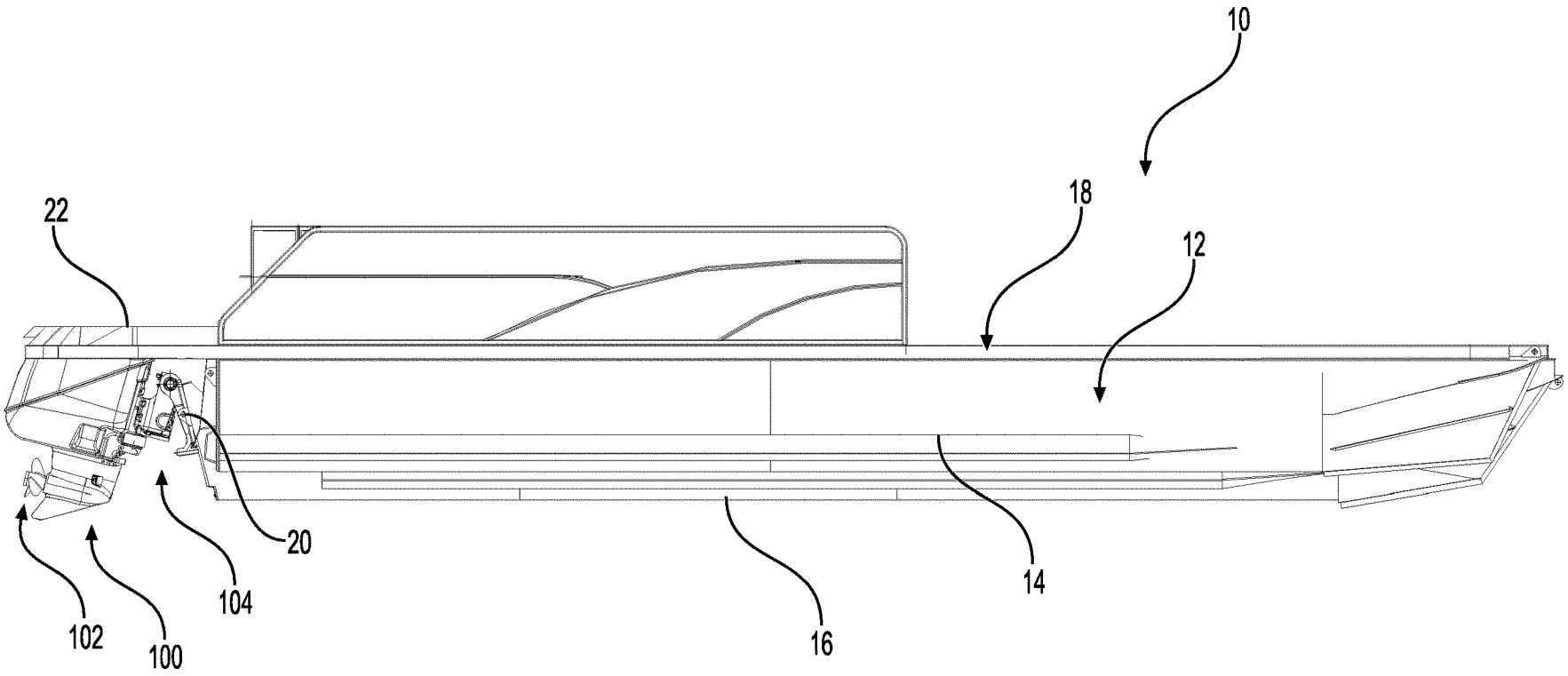
FIG. 1 is a right side elevation view of a watercraft having a marine motor assembly according to an embodiment of the present technology.

In FIG. 1, a watercraft 10 is illustrated. The watercraft 10 illustrated is a pontoon boat 10, but this is one non-limiting example of a watercraft according to the present technology and other types of watercraft are contemplated. This particular embodiment of the boat 10 includes a watercraft body 12 formed generally from two side pontoons 14 (only one being illustrated), a central pontoon 16 and a platform 18.

The boat 10 also includes the marine motor assembly 100, also referred to herein as the assembly 100. The assembly 100 is pivotably and rotatably connected to the watercraft body 12 for providing propulsion via a propulsion device 102. The propulsion device 102 is a propeller 102 in the present embodiment, but it is contemplated that the propulsion device 102 could be different in alternative embodiments. For example, it is contemplated that the propulsion device 102 could be an impeller of a marine jet propulsion device or another type of propeller, such as a ducted propeller.

The assembly 100 includes a transom bracket 104 which is fastened to the watercraft body 12. The transom bracket 104 is connected to a transom 20 of the central pontoon 16, such that the assembly 100 is generally disposed below a top surface 22, also called the deck 22, of the platform 18 laterally between the pontoons 14.

With reference to FIGS. 2 to 5, the marine motor assembly 100, shown separately from the watercraft 10, will now be described in more detail. The assembly 100 includes the propeller 102, the transom bracket 104, a housing 106, a motor 108 (best seen in FIG. 4), a housing gearset 300, a gearcase gearset 302, a driveshaft assembly 110 (best seen in FIG. 5) that operatively connects the housing gearset 300 to the gearcase gearset 302, and other components disposed in the housing 106 some of which will be described in more detail below. It is to be noted that in the illustrated embodiment, the motor 108 is an internal combustion engine 108. In other embodiments, however, the motor 108 could be an electric motor.

Figure 2:
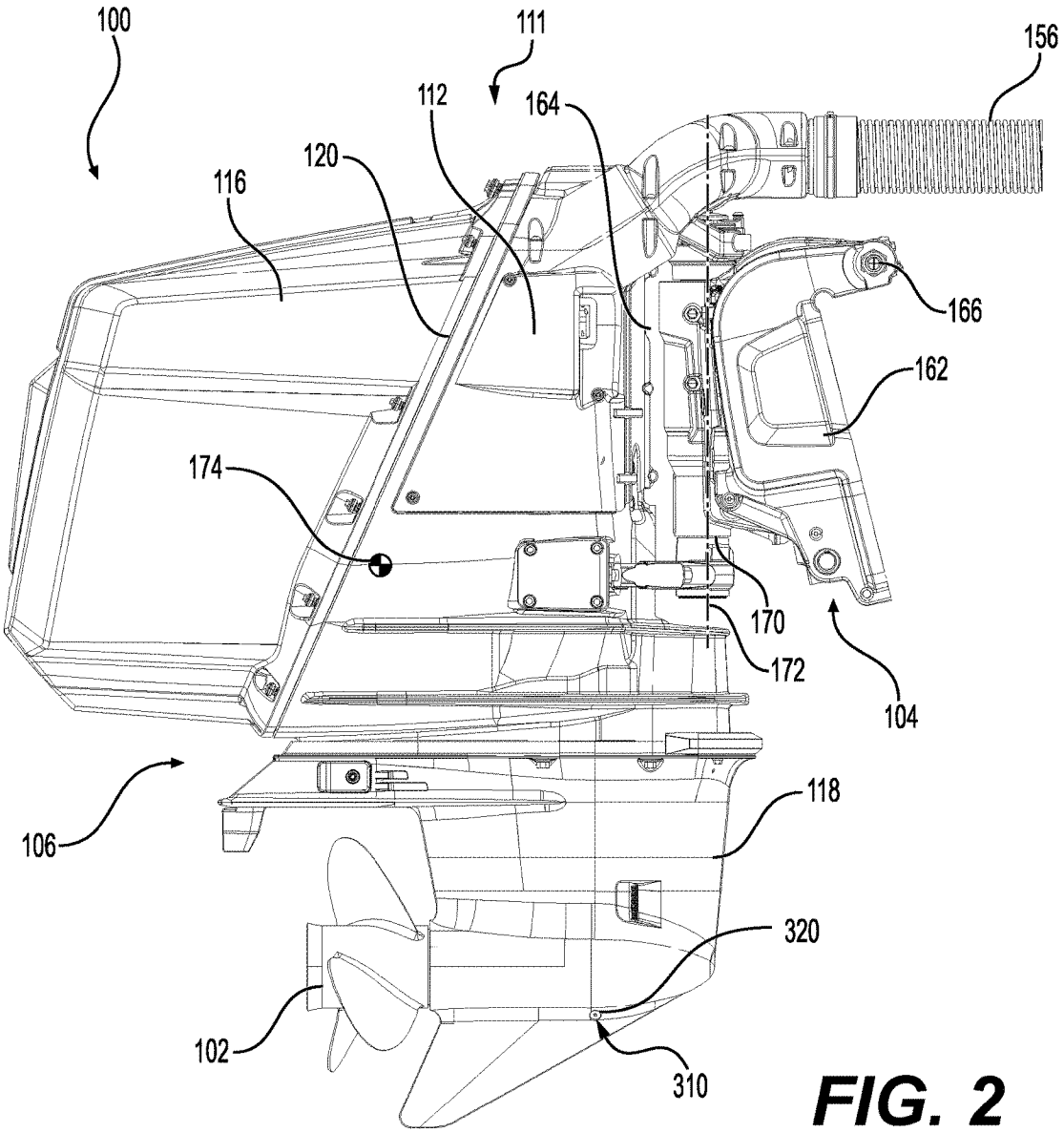
FIG. 2 is a right side elevation view of the marine motor assembly of the watercraft of FIG. 1.
Figure 3:
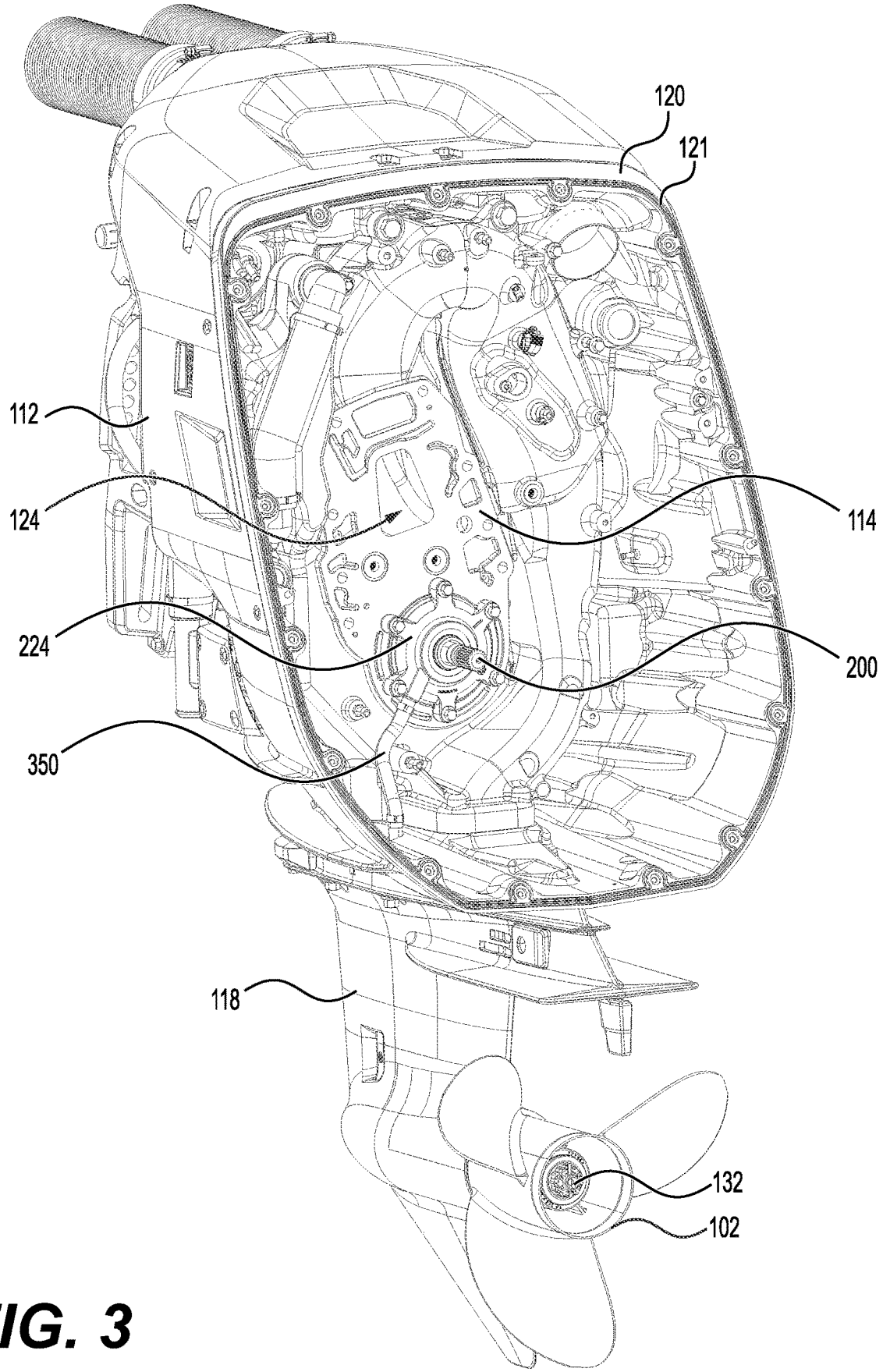
FIG. 3 is a perspective view taken from a rear, left, top side of the marine motor assembly of FIG. 2, with a cover and an engine being omitted.
Figure 4:
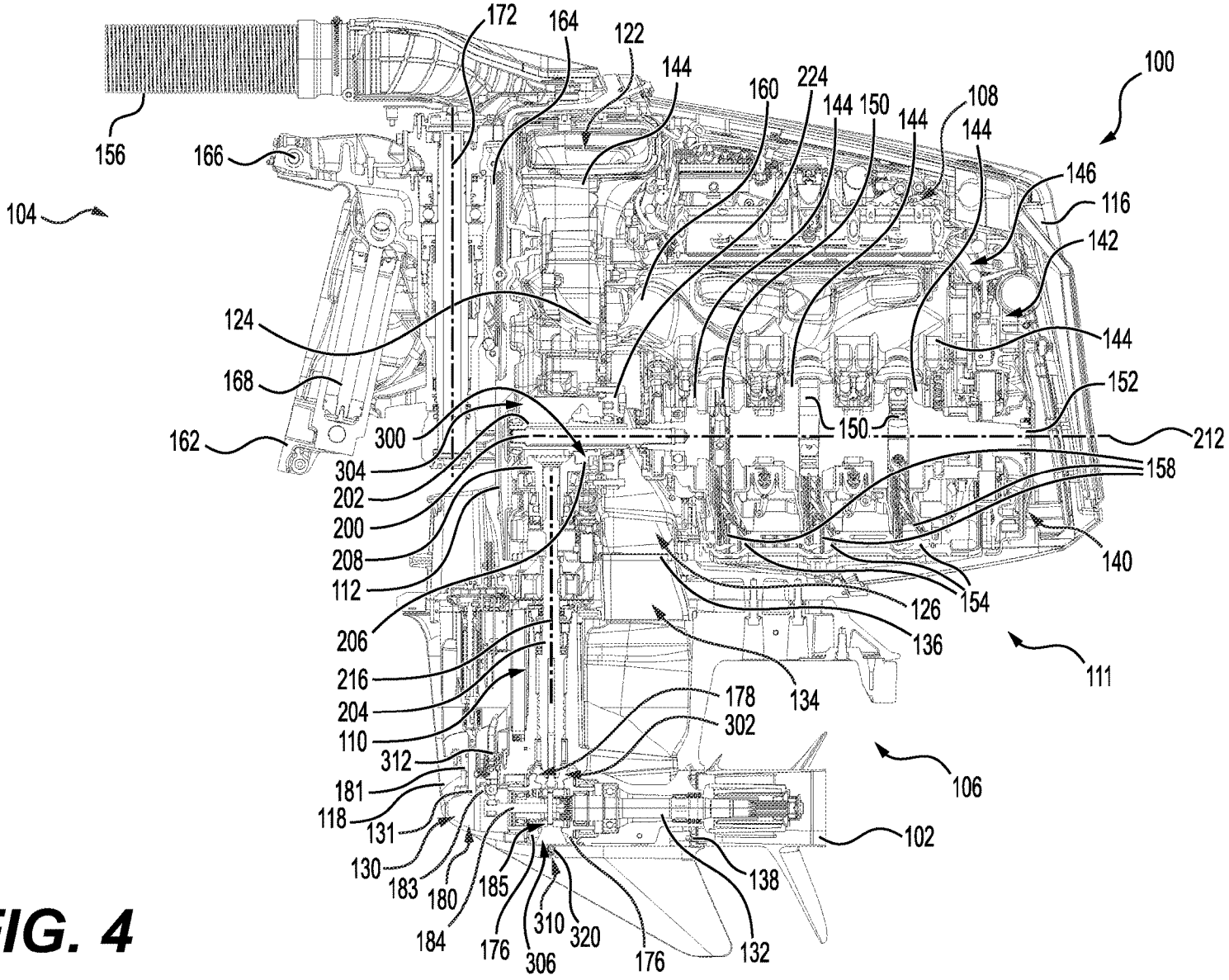
FIG. 4 is a longitudinal cross-section of the marine motor assembly of FIG. 2 taken along a center plane of the marine motor assembly.

With reference to FIGS. 2, the housing 106, which supports and covers components disposed therein, will be described in more detail. The housing 106 includes an upper housing portion 111, which includes an outer housing 112, an inner housing 114, and a cover 116. The housing 106 also includes a gearcase 118 that is connected to the upper housing portion 111. The cover 116 is removably connected to the outer housing 112 along a diagonally extending parting line 120. In the present embodiment, the cover 116 is connected to the outer housing 112 using fasteners, but other types of connections, such as clamps or latches are contemplated. A seal 121 (FIG. 3) is provided between the cover 116 and the outer housing 112 along the parting line 120. The cover 116 and the outer housing 112 define a volume therebetween. The inner housing 114 is disposed in the outer housing 112 and is therefore housed in the volume defined between the cover 116 and the outer housing 112. The internal combustion engine 108, also referred to as engine 108, is connected to a back of the inner housing 114 and is supported in the housing 106 by the inner housing 114. As such, the engine 108 is housed in the volume defined between the cover 116 and the outer housing 112. By removing the cover 116, the engine 108 can be accessed. Part of the inner housing 114 is disposed between the engine 108 and a front of the outer housing 112 as best seen in FIG. 4. As seen in FIG. 4, the inner housing 114 defines an exhaust passage 122 having an inlet 124 (FIG. 3) fluidly communicating with exhaust ports (not shown) of the engine 108 and a downward facing outlet 126 at a bottom thereof that fluidly communicates with the gearcase 118 as described below. The inner housing 114 also defines a housing chamber 304 that contains lubricant (not shown) and that houses the housing gearset 300 and a portion of the driveshaft assembly 110. The housing chamber 304 will be described in greater detail below.

The gearcase 118 is connected to a bottom of the outer housing 112. The gearcase 118 at least in part houses a transmission 130, which includes the gearcase gearset 302, and a propulsion shaft 132 selectively driven by the transmission 130. More specifically, the gearcase 118 defines a gearcase chamber 306 that houses the gearcase gearset 302, other parts of the transmission 130 and part of the propulsion shaft 132. The gearcase chamber 306 will be described in greater detail below. The propulsion shaft 132 is connected to and drives the propeller 102. As in the present embodiment the propulsion shaft 132 drives the propeller 102, it can also be referred to as a propeller shaft 132. The gearcase 118 also defines an exhaust passage 134 having an inlet 136 at a top thereof and an outlet 138 at a rear thereof. During operation, exhaust gases flow from the exhaust ports of the engine 108 into the exhaust passage 122 of the inner housing 114 via the inlet 124, then flows out of the exhaust passage 122 via the outlet 126, then into the exhaust passage 134 of the gearcase 118 via the inlet 136, then out of the exhaust passage 134 into the propeller 102 via the outlet 138.

In the present embodiment, the outer and inner housings 112, 114 are cast metal parts, but other materials and manufacturing methods are contemplated. It is also contemplated that the outer and inner housings 112, 114 could be made as a single integral component, or could be made as more than two components that are then connected together. The cover 116 is made from a composite material, such as a glass fiber and thermoset or thermoplastic resin composite, and the gearcase 118 is made from cast aluminum, but other materials are contemplated.

In the present implementation, the engine 108 is a three-cylinder, two-stroke, gasoline-powered, direct injected internal combustion engine. It is contemplated that the engine 108 could be a four-stroke internal combustion engine. It is contemplated that the engine 108 could have more or less than three cylinders. In some implementations, the engine 108 could use a fuel other than gasoline, such as diesel.

With reference to FIG. 4, the engine 108 includes a crankcase 140. A cylinder block 142 defining three cylinders 144 is disposed above the crankcase 108. A cylinder head 146 is disposed on top of the cylinder block 142. Each cylinder 144 has a piston 148 (FIG. 5) reciprocally received inside of it. Each piston 148 is connected by a corresponding connecting rod 150 to a crankshaft 152. The crankshaft 152 rotates in the crankcase 140. For each cylinder 144, the piston 148, the cylinder 144 and the cylinder head 146 define together a combustion chamber. For each combustion chamber, a direct fuel injector (not shown) supported by the cylinder head 146 is provided to inject fuel into the combustion chamber, and a spark plug (not shown) extends into the combustion chamber through the cylinder head 146 to ignite an air-fuel mixture inside the combustion chamber.

The engine 108 includes one air intake 154 per cylinder 144. The air intakes 154 are provided at the bottom of the crankcase 140. Air is delivered to the air intakes 154 by an air intake assembly (not shown). Air is supplied to the air intake assembly by an air intake hose 156. The air passes through reed valves 158 provided in the crankcase 140 adjacent to the air intakes 154. The reed valves 158 allow air to enter the crankcase 140 but prevent air from exiting the crankcase 140. For each cylinder 144, a transfer port (not shown) communicates the crankcase 140 with the corresponding combustion chamber for air to be supplied to the combustion chamber.

Each combustion chamber has a corresponding exhaust port (not shown). Exhaust gases flow from the combustion chambers, through the exhaust ports, into an exhaust manifold 160 (partially shown in FIG. 4). Each exhaust port has a corresponding reciprocating exhaust valve (not shown) that varies the effective cross-sectional area and timing of its exhaust port. From the exhaust manifold 160, the exhaust gases are routed out of the assembly 100 via the exhaust passages 122, 134 and the propeller 102 as described above.

The reciprocation of the pistons 148 causes the crankshaft 152 to rotate. The crankshaft 152 drives, via the housing gearset 300, the driveshaft assembly 110. The driveshaft assembly 100, in turn, drives the transmission 130 via the gearcase gearset 302, which drives the propeller shaft 132, which drives the propeller 102, as is described in more detail below. As can be seen in FIG. 4, in the present embodiment the crankshaft 152 and the propeller shaft 132 are parallel to each other. It is contemplated that in alternative embodiments, the engine 108 could be oriented such that the crankshaft 152 extends generally vertically and is therefore perpendicular to the propeller shaft 132.

With reference to FIGS. 2 and 4, the transom bracket 104 includes a watercraft portion 162 which is adapted for fastening to the watercraft body 12. The transom bracket 104 also includes an engine portion 164, pivotally connected to the watercraft portion 162, and which is fastened to the front of the outer housing 112. The engine portion 164 is pivotable with respect to the watercraft portion 162 about a tilt-trim axis 166. The transom bracket 104 thus defines the tilt-trim axis 166 of the assembly 100, about which the assembly 100 can be trimmed or tilted relative to the watercraft body 12. The engine portion 164 of the transom bracket 104 includes a tilt and trim actuator 168 for tilting or trimming the assembly 100 relative to watercraft body 12. It is contemplated that the actuator 168 could only trim the assembly 100, in which case the actuator 168 would be a trim actuator. In the present embodiment, the tilt and trim actuator 168 is a linear hydraulic actuator adapted for pushing the engine portion 164 away from the watercraft portion 162, but other types of tilt and trim actuators 168 are contemplated, such as those described in U.S. Pat. No. 11,180,235 B2, issued on Nov. 23, 2021 and entitled "Stern and Swivel Bracket Assembly for Mounting a Drive Unit to a Watercraft", U.S. Pat. No. 7,736,206 B1, issued on Jun. 15, 2010 and entitled "Integrated Tilt/trim and Steering Subsystem for Marine Outboard Engines", and U.S. Pat. No. 9,499,247 B1, issued on Nov. 22, 2016 and entitled "Marine Outboard Engine Having a Tilt/trim And Steering Bracket Assembly", the entirety of each of which is incorporated herein by reference.

The engine portion 164 includes a steering actuator 170 configured for steering the housing 106, and therefore the propeller 102, relative to the transom bracket 104 about a steering axis 172. In the present embodiment, the steering actuator 170 is a rotary hydraulic actuator, but other types of steering actuators 170 are contemplated.

As can be seen in FIG. 2, the center of gravity 174 of the engine 108 is disposed below the tilt-trim axis 166, when the assembly 100 is in a trim range. As the assembly 100 is designed to be disposed below the deck 18, the engine 108 and the transom bracket 104 partially vertically overlap, rather than the engine 108 being disposed well above the bracket 104 as would be the case in a conventional outboard engine assembly meant to extend higher relative to the watercraft body 12. In the present embodiment, the center of gravity 174 is vertically between a top end of the transom bracket 104 and a bottom end of the transom bracket 104.

Figure 5:
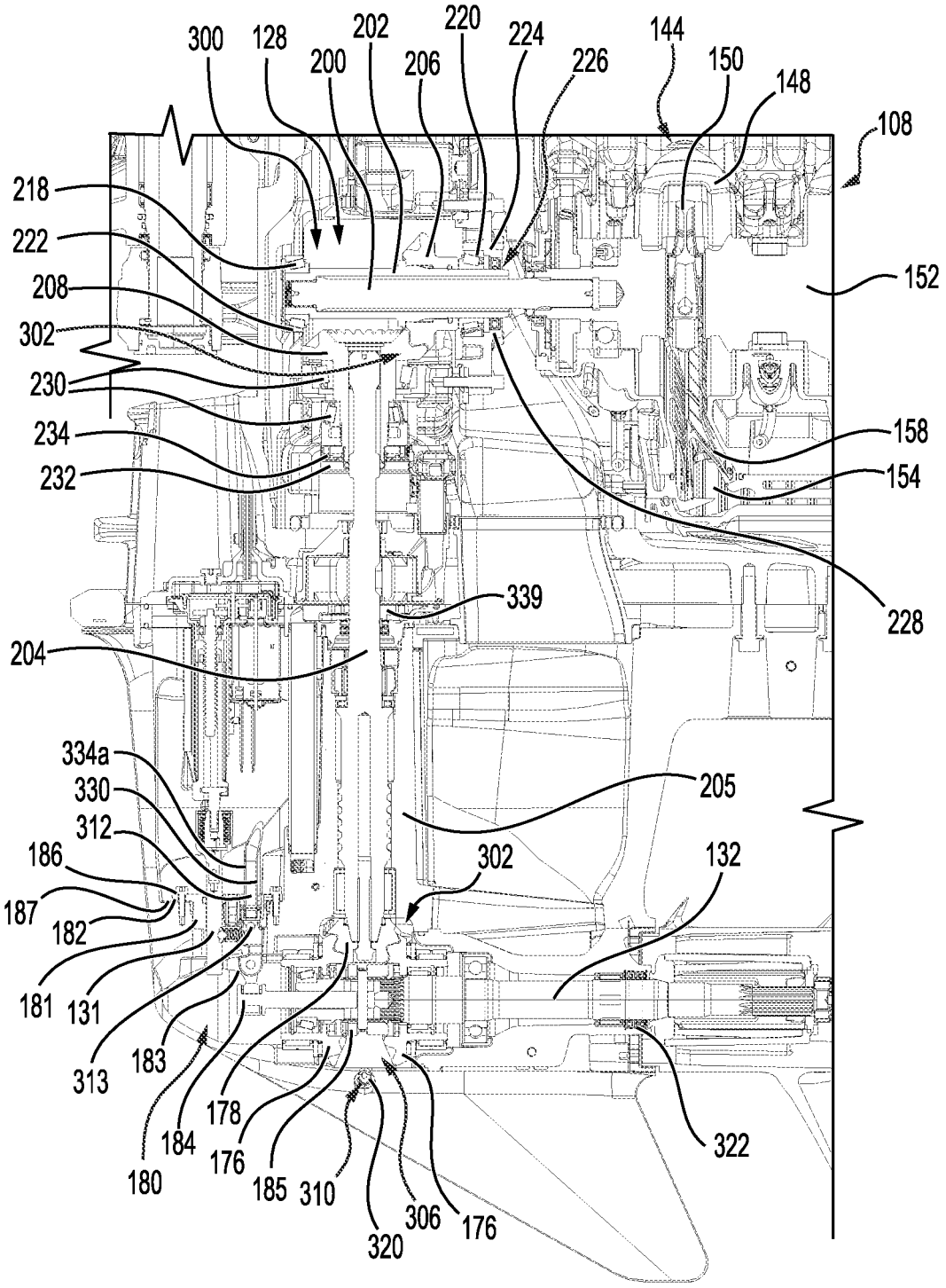
FIG. 5 is a close-up of a portion of the longitudinal cross-section of FIG. 4 where a driveshaft assembly of the marine motor assembly is located.
Figure 6:
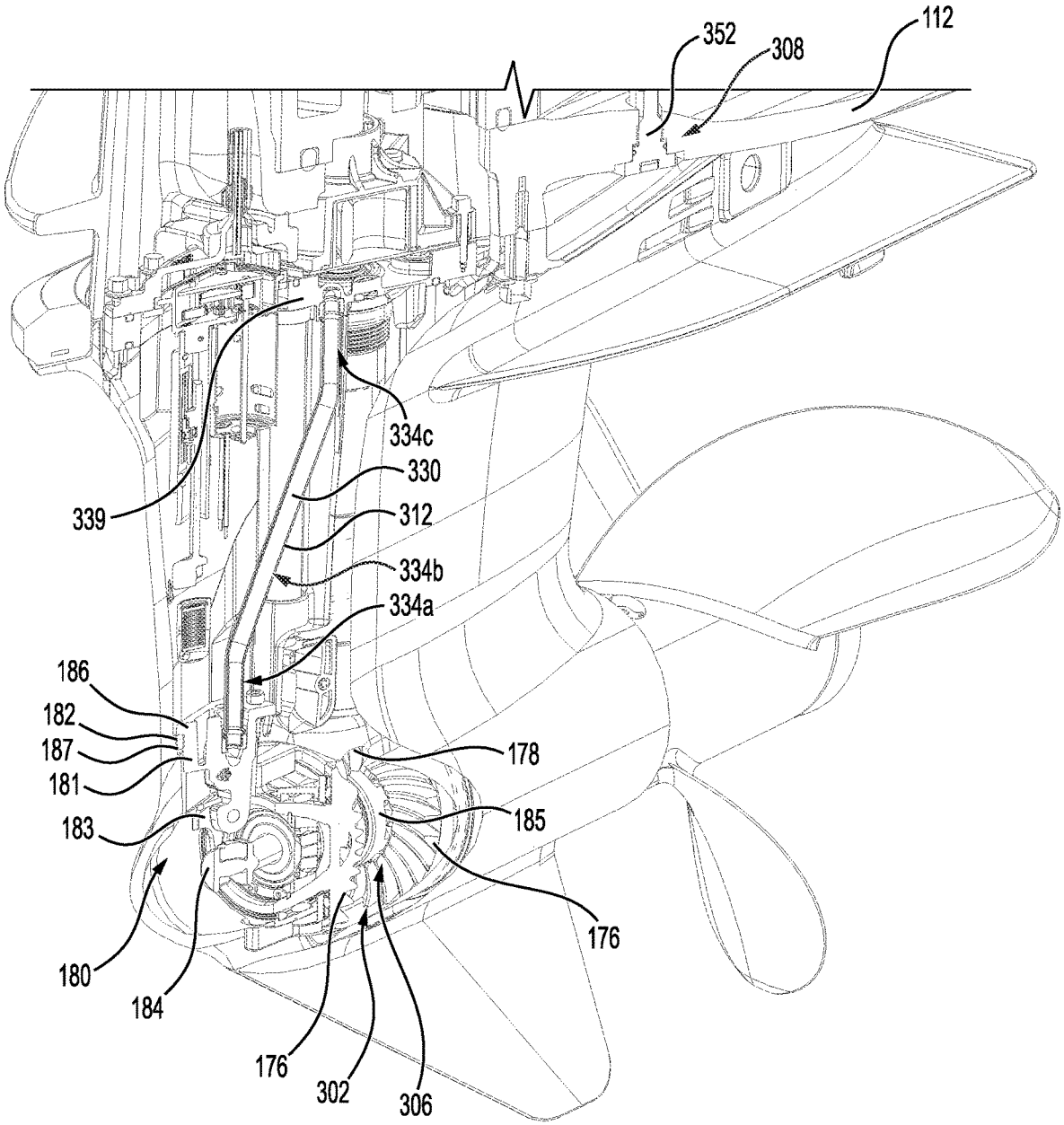
FIG. 6 is a perspective view taken from a top, front, left side of a partial cross-section of a lower portion of the marine motor assembly of FIG. 2.

Turning back to FIG. 4, the gearcase gearset 302, along with the transmission 130 and its connection to the propeller shaft 132 will be described in more detail. The gearcase gearset 302 includes two bevel gears 176 that are longitudinally spaced from one another, and a pinion gear 178 that is drivingly engaged with the bevel gears 176. The two bevel gears 176 and the pinion gear 178 are all disposed in the gearcase chamber 306. The two bevel gears 176 are rotationally supported on a front portion of the propeller shaft 132, whereas the pinion gear 178 is connected to a lower end of the driveshaft assembly 110. In the present embodiment, the pinion gear 178 is also a bevel gear. The front bevel gear 176 is disposed in front of an axis of rotation of the pinion gear 178 and the rear bevel gear 176 is disposed behind the axis of rotation of the pinion gear 178. As a result, when the pinion gear 178 rotates, the two bevel gears 176 are configured to rotate in opposite directions. A dog-clutch assembly 180 selectively rotationally fixes one or the other of the bevel gears 176 to the propeller shaft 132, thereby determining a direction of rotation of the propeller shaft 132 and propeller 102. The dog-clutch assembly 180 includes a shifter bracket 181, a seal 182, a lever 183, a selection shaft 184, and a dog 185. As will be described in greater detail below, the dog-clutch assembly 180 is used in sealing the gearcase chamber 306 from a front portion of the gearcase 118. The shifter bracket 181 is connected to the gearcase 118, and the seal 182 is disposed radially between a lip 186 of the shifter bracket 181 and an abutting surface 187 of the gearcase 118 (FIGS. 5 and 6). The shifter bracket 181 receives therethrough part of a shifter 131 of the transmission 130. The shifter bracket 181 also receives therethrough part of a fluid conduit 312. The fluid conduit 312 will be described in greater detail below. One end of the lever 183 is pivotally connected to the shifter bracket 181, and another end is connected to the selection shaft 184 which can rotate relative to the shifter bracket 181. The selection shaft 184 is connected to the dog 185 to cause the dog 185 to slide along the propeller shaft 132. The dog 185 is connected to the propeller shaft 132 by splines so as to be rotationally fixed relative to the propeller shaft 132. The dog 182 is disposed longitudinally between the front and rear bevel gears 176. In response to a vertical movement of the shifter 131, the lever 183 pivots which causes the selection shaft 184 to translate about its center axis, thereby causing the dog 185 to slide relative to the propeller shaft 132. By sliding the dog 185 rearward, the dog 185 engages the rear bevel gear 176 such that the rear bevel gear 176 drives the propeller shaft 132. By sliding the dog 185 forward, the dog 185 engages the front bevel gear 176 such that the front bevel gear 176 drives the propeller shaft 132. By sliding the dog 185 between the bevel gears 176 such that the dog 185 does not engage either one of the bevel gears 176, the transmission 130 is said to be in a neutral position. In the neutral portion, the propeller shaft 132 is not driven by the bevel gears 176.

Turning to FIG. 5, the driveshaft assembly 110 will be described in more detail. The driveshaft assembly 110 has three driveshafts 200, 202, 204 and the housing gearset 300. In some embodiments, the pinion gear 178 could be considered as being part of the driveshaft assembly 110 as well as the transmission 130.

The driveshaft 200 is coaxial with the crankshaft 152. The driveshaft 200 has a rear end received in the front end of the crankshaft 152 directly connected to the crankshaft 152 by splines (not shown) such that the crankshaft 152 drives the driveshaft 200. It is contemplated that the driveshaft 200 could connect to the crankshaft 152 by means other than splines, such as by threads for example. It is contemplated that in alternative embodiments, the crankshaft 152 could extend generally vertically, such that the crankshaft 152 would be perpendicular to the driveshaft 200 and would drive the driveshaft 200 via bevel gears for example. It is also contemplated that in alternative embodiments, the crankshaft 152 and the driveshaft 200 could be parallel to each other such that the crankshaft 152 would drive the driveshaft 200 via spur gears, helical gears or a chain drive for example. It is also contemplated that one or more intermediate shafts could be provided between the crankshaft 152 and the driveshaft 200 to operatively connect the crankshaft 152 to the driveshaft 200. It is also contemplated that the crankshaft 152 and the driveshaft 200 could be integrally formed as a single shaft.

The driveshaft 200 is disposed in part inside the driveshaft 202, which is tubular, such that the driveshafts 200, 202 are concentric. As such, the driveshafts 200, 202 and the crankshaft 152 are coaxial and rotate about a common axis of rotation 212 (FIG. 4). Also, the driveshafts 200, 202 are parallel to the propeller shaft 132. The front end of the driveshaft 200 is connected to the front end of the driveshaft 202 by threads (not shown) such that the driveshaft 200 drives the driveshaft 202. The direction of the threads is selected such that during operation the front ends of the driveshafts 200, 202 are rotationally fixed relative to each other. It is contemplated that the front ends of the driveshafts 200, 202 could be connected to each other by means other than threads, such as by splines for example. From its front end, the driveshaft 202 extends rearward toward the rear end of the driveshaft 200 and the crankshaft 152. As can be seen, the driveshaft 202 is shorter than the driveshaft 200. As such, the driveshaft 200 extends rearwardly out of the driveshaft 202, and the rear end of the driveshaft 202 is longitudinally between the front and rear ends of the driveshaft 200.

The driveshaft 202 is operatively connected to the driveshaft 204 via the housing gearset 300. The housing gearset 300, which is disposed in the housing chamber 304, includes a gear 206 and a gear 208. The gears 206, 208, which are drivingly engaged to one another, are bevel gears. The bevel gear 206 is mounted to the driveshaft 202 between the front and rear ends of the driveshaft 202. The bevel gear 206 is mounted to the driveshaft 202 by splines (not shown), but other means are contemplated. On the other hand, the bevel gear 208 is mounted to the upper end of the driveshaft 204 and engages the bevel gear 206 such that the driveshaft 202 is drivingly engaged with the driveshaft 204.

The driveshaft 204 extends perpendicularly to the crankshaft 152, the driveshafts 200, 202, and the propeller shaft 132. The driveshaft 204 is below the driveshafts 200, 202. As can be seen in FIG. 4, an axis of rotation 216 of the driveshaft 204 is perpendicular to the axis of rotation 212 of the crankshaft 152 and the driveshafts 200, 202. The axis of rotation 216 intersects the axis of rotation 212 at a position between the bevel gear 206 and the front end of the driveshaft 202. As can also be seen, the driveshafts 200, 202 extend forward and rearward of the axis of rotation 216. The pinion gear 178 is mounted to the lower end of the driveshaft 204 and drives the transmission 130, which in turn selectively drives the propeller shaft 132 and the propeller 102.

By providing the driveshaft 202 concentrically about the driveshaft 200, the driveshaft assembly 110 provides more torsional compliance in the space available than a driveshaft assembly without the driveshaft 202 where the driveshaft 204 would be driven via bevel gears from the driveshaft 200 (or from the crankshaft 152 should the driveshaft 200 also be omitted), thereby providing more damping of torque variations from the engine 108 while maintaining a relatively compact arrangement.

With reference to FIGS. 4 and 5, it can be seen that the driveshafts 200, 202 are disposed completely inside the volume defined between the cover 116 and the outer housing 112 and that an upper portion the driveshaft 204 is disposed in this volume. As will be described below, the driveshafts 200, 202 extend in part inside the housing chamber 304, whereas the driveshaft 204 extends in part in the housing chamber 304 and in part in the gearcase chamber 306.

The front and rear ends of the driveshaft 202 are rotationally supported in the inner housing 114 by front and rear bearings 218, 220. The front bearing 218 is disposed radially between the front end of the driveshaft 202 and a side wall 222 of a recess defined in the inner housing 114. The rear bearing 220 is disposed radially between the driveshaft 202 and a cover 224. The cover 224 is fastened to a rear side of the inner housing 114 to define a rear side of the housing chamber 304. The cover 224 defines a central aperture 226 through which the driveshafts 200, 202 extend. The bevel gear 206 is disposed next to and in front of the rear bearing 220, and is therefore closer to the rear bearing 220 than to the front bearing 218. A seal 228 is disposed radially between the driveshaft 202 and the cover 224, behind the rear bearing 220. The upper end of the driveshaft 204 is rotationally supported in the inner housing 114 by a pair of bearings 230. More specifically, the bearings 230 are disposed radially between the bevel gear 208 and a wall 232 of the inner housing 114 defining a passage for the driveshaft 204. A seal 234 is disposed radially between the bevel gear 208 and the wall 232 below the bearings 230. In the present embodiment, the bearings 218, 220, 230 are single row tapered roller bearings. It is contemplated that the bearings 218, 220, 230 could be of a different type and that not all of the bearings 218, 220, 230 are of the same type. The bearings 218, 220, 230 are disposed in the housing chamber 304.

During operation of the assembly 100, various components of the assembly 100 such as the housing and gearcase gearsets 300, 302 and the bearings 218, 220, 230 require lubrication. To this end, lubricant is present within the housing 106, including in the housing chamber 304 and the gearcase chamber 306 for lubricating the housing gearset 300 and the gearcase gearset 302 respectively, as well as the bearings 218, 220, 230. The lubricant circulates in the housing 106. Circulation of the lubricant between the housing chamber 304 and the gearcase chamber 306 can be due to free convection. More specifically, circulation of the lubricant between the housing chamber 304 and the gearcase chamber 306 can be driven by temperature differences therebetween. Additionally, circulation of the lubricant in the gearcase chamber 306 can be driven a pump (not shown). For lubricating various components of the assembly 100 and for replacing lubricant in the housing 106 when desired (e.g., once the lubricant has degraded), the housing 106 has the housing chamber 304, the gearcase chamber 306, a housing fluid port 308 (FIG. 6), a gearcase fluid port 310 and a fluid conduit 312, all of which are fluidly connected as described below.

With reference to FIG. 5, the gearcase fluid port 310 is disposed on an exterior surface of the gearcase 118. The gearcase fluid port 310 is an aperture that can be selectively closed by a gearcase plug 320. The gearcase plug 320 can be a screw in some embodiments. The gearcase fluid port 310, when the gearcase plug 320 is not plugged into the gearcase fluid port 310, provides access to the gearcase chamber 306, such that lubricant can flow from outside the assembly 100 to inside the gearcase chamber 306 and vice versa. In the present embodiment, the gearcase fluid port 310 is positioned to be at a bottom of the gearcase chamber 306, and is fluidly connected thereto.

The gearcase chamber 306 is fully defined in the gearcase 118 and extends in the longitudinal direction. As mentioned above, the gearcase chamber 306 houses the gearcase gearset 302, part of the transmission 130 and part of the propulsion shaft 132. It is to be noted that the radial size of the gearcase chamber 306 varies longitudinally for accommodating various components of the gearcase 118. A rear end of the gearcase chamber 306 is sealed from a rear portion of the gearcase 118 by seal 322. A front end of the gearcase chamber 306 is sealed by the dog-clutch assembly 180. As mentioned above, the shifter bracket 181 and the seal 182 seal the gearcase chamber 306 from a front top portion of the gearcase 118. The gearcase chamber 306 is fluidly connected to the fluid conduit 312.

Figure 7:
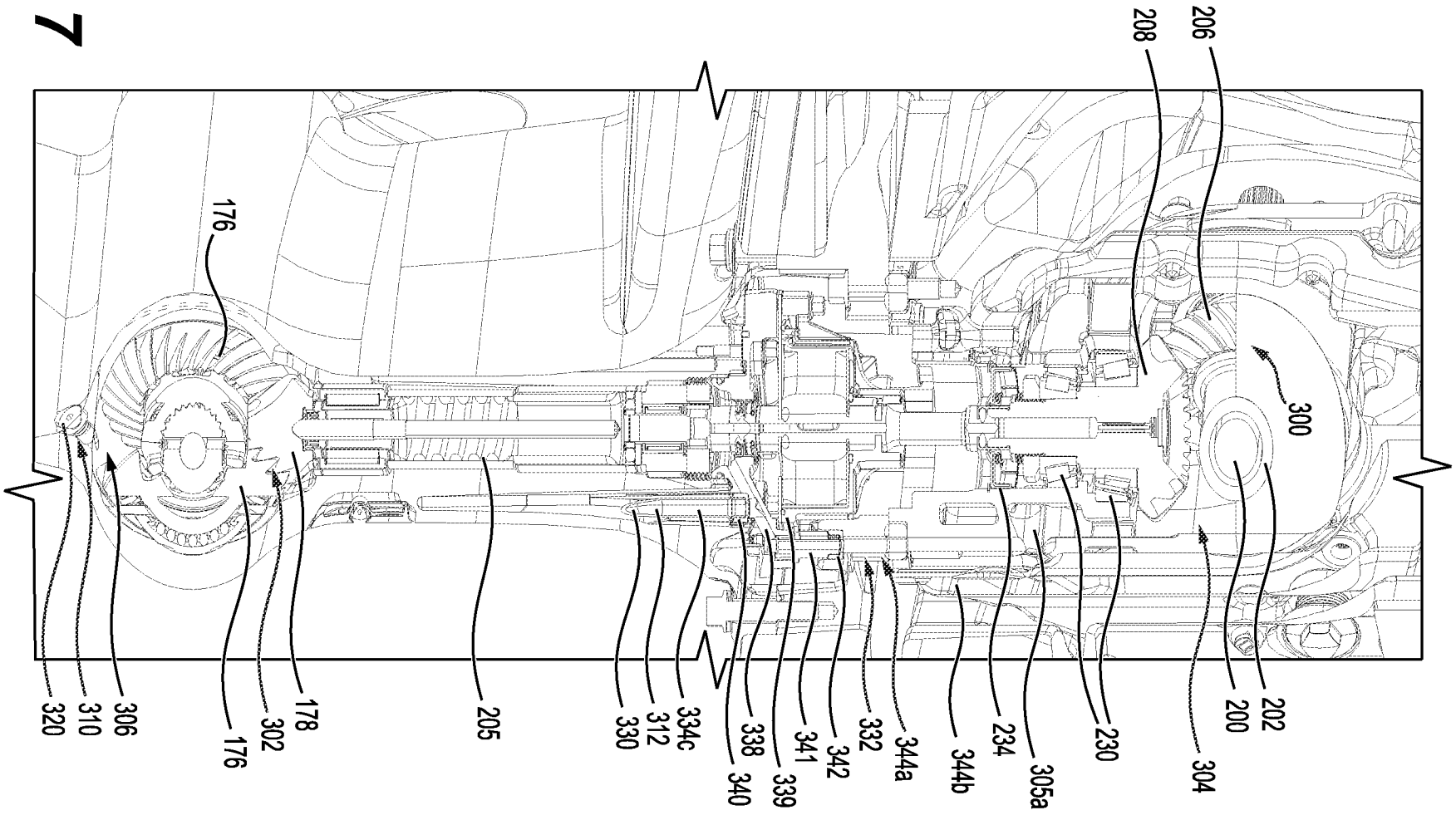
FIG. 7 is a perspective view taken from a top, front, right side of a partial cross-section of the lower portion of the marine motor assembly of FIG. 2.

Referring to FIGS. 5 to 7, the fluid conduit 312 will now be described. As will be clarified below, the fluid conduit 312 is only partially shown in FIGS. 5 to 7, due to an orientation thereof. The fluid conduit 312 includes a transverse channel 313 that is formed by the shift bracket 181 and is open to the housing chamber 304. The fluid conduit 312 further includes a gearcase section 330 that extends in the gearcase 118, and a housing section 332 that extends in the upper housing portion 111. The gearcase section 330 is a pipe 330 that extends upwardly through the shifter bracket 181. The pipe 330 has a pipe segment 334*a* that extends generally vertically, a pipe segment 334*b* that extends generally vertically, rearwardly and laterally from the pipe segment 334*a*, as well as a pipe segment 334*c* that extends generally vertically from the pipe segment 334*c*. It is contemplated that in other embodiments, the pipe 330 could have more or less sections. It is further contemplated that in other embodiments, the pipe 330 could be a hose or other form of conduit. The pipe segment 334*c* is fluidly connected to a circulation channel 338, which circulates lubricant to various components in the housing 106. The circulation channel 338 is formed in the water pump impeller housing 339 that closes a top portion of the gearcase chamber 306. More specifically, lubricant is supplied to the circulation channel 338 by the driveshaft 100 by an Archimedes screw 205 (FIGS. 5 and 7) defined on the driveshaft 204. A seal 340 is provided between a tail end of the pipe segment 334*c* and water pump impeller housing 339 around the circulation channel 338 for preventing leakage therebetween. In some embodiments, the circulation channel 338 could be omitted. The circulation channel 338 is in turn fluidly connected to the housing section 332. A nipple 341 is provided between water pump impeller housing 339 and the upper housing 111 to connect the circulation channel 338 and the housing section 332. A seal 342 is provided between the nipple 341 and the upper housing 111 for preventing leakage therebetween. The housing section 332 is a channel 332 that is defined in the upper housing portion 111. More specifically, the channel 332 includes a channel segment 344*a* that is defined in the outer housing 112, and a channel segment 344*b* that is defined in the inner housing 114. The channel segment 344*a* extends upwardly from the circulation channel 338 to the channel segment 344*b*, and the channel segment 344*b* extends upwardly into an inlet 305*a* of the housing chamber 304 where the inlet 305*a* extends generally horizontally. It is contemplated that in other embodiments the fluid conduit 312 could be a continuous pipe extending between the gearcase chamber 306 and the housing chamber 304. Thus, the fluid conduit 312 fluidly connects the gearcase chamber 306 to the housing chamber 304.

The housing chamber 304 is defined by the inner housing 114 and the cover 224. A lower end of the housing chamber 304 is sealed from a rest of the inner housing 114 by the seal 234 (best seen in FIG. 7). It is contemplated that in other embodiments, the housing chamber 304 could be fully defined by the inner housing 114. In other embodiments, the housing chamber 304 could be defined by the inner and outer housings 114, 112. The housing chamber 304 is spaced from the gearcase chamber 306. More specifically, when the assembly 100 is in the neutral trim position, the housing chamber 304 is vertically spaced from the gearcase chamber 306, with the housing chamber 304 being higher than the gearcase chamber 306. Although in the present embodiment the housing and gearcase chambers 304, 306 are longitudinally and laterally aligned, it is contemplated that in some embodiments, the housing and gearcase chambers 304, 306 could be longitudinally and/or laterally offset from one another.

Figure 8:
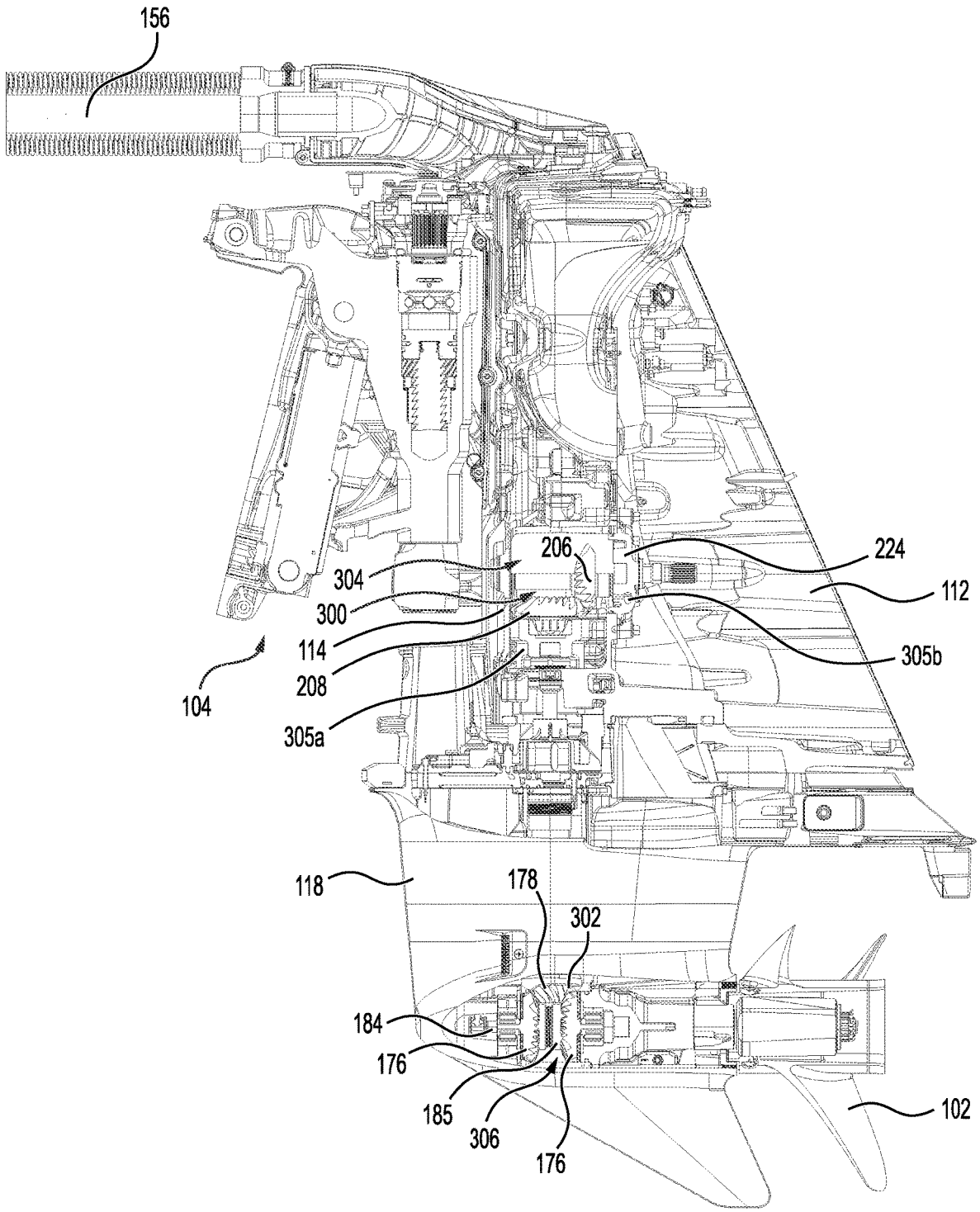
FIG. 8 is longitudinal cross-section of the components of the marine motor assembly of FIG. 3, the cross-section being taken along a plane laterally offset from center plane of the marine motor assembly.

The housing chamber 304 is fluidly connected to the housing fluid port 308 (FIG. 6). More specifically, the housing chamber 304 is fluidly connected to the housing fluid port 308 via a secondary fluid conduit 350 (FIG. 3) that is connected to an outlet 305*b* (FIG. 8) formed in the cover 224 of the housing chamber 304. When the assembly 100 is in the neutral trim position, the outlet 305*b* is disposed vertically higher than a lower edge of the gears 206, 208 (i.e., vertically higher than a lower edge of the housing gearset 300). This can assist in ensuring that the gears 206, 208 and other components disposed in the housing chamber 304 (e.g., bearings) are adequately lubricated (e.g., via splash lubrication). Additionally, the outlet 305*b* is vertically spaced from a top of the housing chamber 304 for providing clearance for a compressible gas (e.g., air) within the housing chamber 304.

The secondary fluid conduit 350 extends generally downwardly from the housing chamber 304 toward the housing fluid port 308. As a result of the secondary fluid conduit 350 extending downwardly from the housing chamber 304, when lubricant in the housing chamber 304 is at a level higher than the outlet 305*b*, said lubricant flows toward the housing fluid port 308 due to gravity. This can, in some instances, assist in reducing chances of overfilling the housing chamber 304 with lubricant.

The housing fluid port 308 is disposed on an exterior surface of the housing 106. More specifically, the housing fluid port 308 is disposed vertically below the housing chamber 304 on a downward facing surface of the outer housing 112. This position of the housing fluid port 308 can assist in drainage of the lubricant in the secondary passage 350. The housing fluid port 308 is an aperture that can be selectively closed by a housing plug 352. The housing plug 352 can be a screw in some embodiments. The housing fluid port 308, when the gearcase plug 352 is not plugged into the housing fluid port 308, allows air to enter and exit the housing chamber 304 as lubricant is drained out of and pumped into the gearcase chamber 306.

Due to the fluid connections described hereabove in the housing 106, lubricant in the housing chamber 304 and in the gearcase chamber can be replaced, (once the housing 106 has been drained), by pumping lubricant into a single pair of fluid ports, namely the housing and gearcase fluid ports 308, 310, rather than having to pump lubricant in two different pairs of fluid ports. Thus, the present technology enables a person to replace lubricant for two different gearsets that are spaced from one another, namely the housing gearset 300 and the gearcase gearset 302, by a single lubricant replacing operation. Additionally, by avoiding a second pair of fluid ports, a drag of the gearcase 118 while in operation is reduced. Furthermore, avoiding a second pair of fluid ports can reduce costs and/or complexity of manufacturing and/or assembling the assembly 100.

Figure 9:
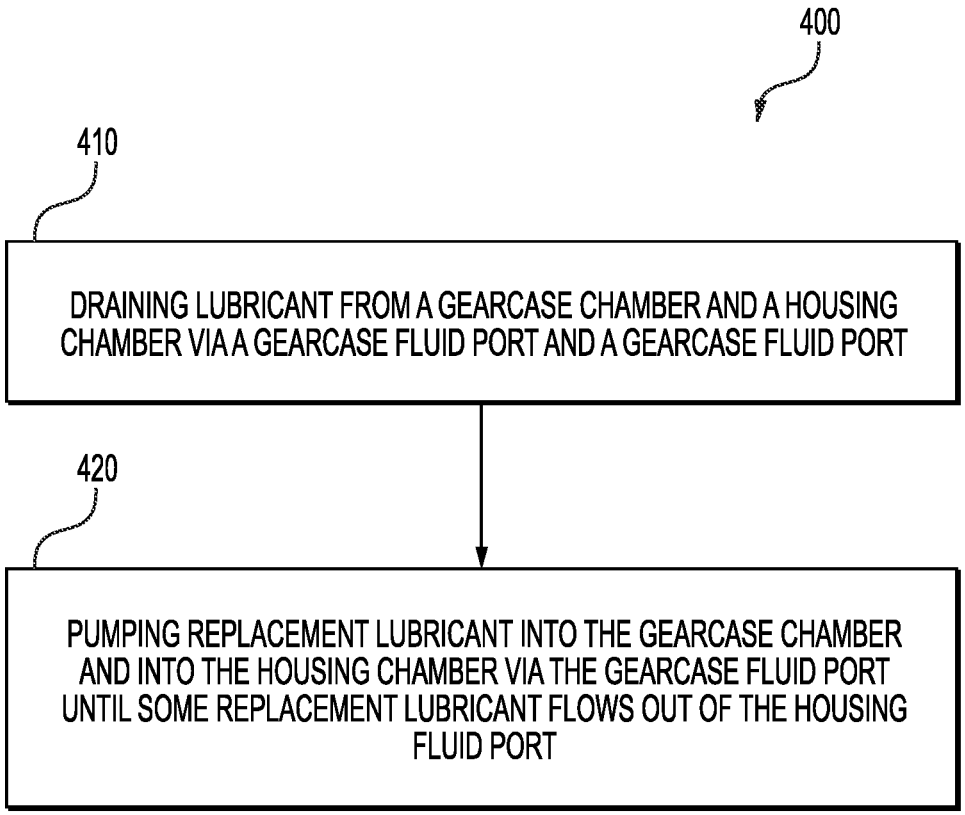
FIG. 9 is a flowchart for a method for replacing lubricant in the marine motor assembly of FIG. 2.

With reference to FIG. 9, a method 400 for changing the lubricant in the assembly 100 will now be described.

In step 410, lubricant is drained from the housing 106. To do so, the gearcase plug 320 is removed from the gearcase fluid port 310 and the housing plug 352 is removed from the housing fluid port 308, resulting in the lubricant being drained from the housing chamber 304 and the gearcase chamber 306 via the housing fluid port 308 and the gearcase fluid port 310. As the gearcase fluid port 310 is at a bottom of the housing 106, most of the lubricant in the housing 106 flows out of the gearcase fluid port 310. Some of the lubricant also flows out of the housing fluid port 308, particularly if a level of lubricant in the housing chamber 304 is above the outlet 305*b*. As lubricant is drained from the housing 106, primarily via the gearcase fluid port 310, an equal volume of air can enter the housing 106, primarily via the housing fluid port 308. Eventually, lubricant stops flowing out of the gearcase fluid port 310 and the housing fluid port 308 indicating that there is no more (or very little) lubricant in the housing 106.

In step 420, replacement lubricant is pumped into the housing 106 (housing chamber 304 and the gearcase chamber 306) via the gearcase fluid port 310 until replacement lubricant begins to flow out of the housing fluid port 308. As replacement lubricant is pumped in via the gearcase fluid port 310, an equal volume of air can exit via the housing fluid port 308. In more detail, pumping the replacement lubricant into the gearcase fluid port 310, which is at a bottom of the housing 106 causes the replacement lubricant to first fill the gearcase chamber 306. As the level of the replacement lubricant rises, it will reach the transverse channel 313 formed in the shifter bracket 181 and through which it will enter the fluid conduit 312. The replacement lubricant fills the gearcase section 330 of the fluid conduit 312, then fills the circulation channel 338 of the fluid conduit 312, and then the housing section 332 of the fluid conduit 312. Eventually, the replacement lubrication reaches the housing chamber 304. The replacement lubrication starts filling the housing chamber 304 until a level of replacement lubrication in the housing chamber 304 reaches the outlet 305*b*, at which point the level is higher than a lower edge of the gears 206, 208. Then, the replacement lubricant flows into the secondary conduit 350, and then out of housing fluid port 308. This indicates that there is sufficient replacement lubricant in the housing 106, and pumping of the replacement lubricant can be stopped, and the gearcase plug 320 can be plugged into the gearcase fluid port 310, and the housing plug 352 can be plugged into the housing fluid port 308.

Modifications and improvements to the above-described embodiments of the present technology may become apparent to those skilled in the art. The foregoing description is intended to be exemplary rather than limiting.

What is claimed is:

1. A marine motor assembly for a watercraft, the marine motor assembly comprising:

a housing comprising:

an upper housing portion;

a gearcase connected to the upper housing portion, the gearcase comprising:

a gearcase chamber; and a gearcase fluid port disposed on an exterior surface of the gearcase, a housing chamber spaced from the gearcase chamber;

a housing fluid port disposed on an exterior surface of the housing, the housing fluid port being fluidly connected to the housing chamber; and a fluid conduit fluidly connecting the gearcase chamber to the housing chamber, a motor disposed in the housing;

a housing gearset disposed in the housing chamber, the housing gearset being operatively connected to the motor; and a gearcase gearset disposed in the gearcase chamber, the gearcase gearset being operatively connected to the housing gearset; and a propulsion device operatively connected to the gearcase gearset.

2. The marine motor assembly of claim 1, wherein the housing gearset includes bevel gears.

3. The marine motor assembly of claim 1, further comprising a driveshaft operatively connecting the housing gearset to the gearcase gearset.

4. The marine motor assembly of claim 3, wherein the motor is an internal combustion engine, and the driveshaft is oriented generally perpendicularly relative to a crankshaft of the internal combustion engine.

5. The marine motor assembly of claim 1, wherein the gearcase gearset includes bevel gears.

6. The marine motor assembly of claim 5, wherein the gearcase gearset includes a first bevel gear, a second bevel gear, and a pinion engaging the first and second pinion bevel gears, the pinion being operatively connected to the housing gearset; and the marine motor assembly further comprising: a dog-clutch assembly selectively operatively connecting one of the first and second bevel gears to the propulsion device.

7. The marine motor assembly of claim 1, wherein the housing chamber is located vertically above the gearcase chamber.

8. The marine motor assembly of claim 1, wherein the housing chamber is in the upper housing portion.

9. The marine motor assembly of claim 1, wherein the housing fluid port is disposed on the upper housing portion.

10. The marine motor assembly of claim 9, wherein the housing fluid port is disposed on a downward facing surface of the upper housing portion.

11. The marine motor assembly of claim 1, wherein the gearcase fluid port is disposed on a bottom of the gearcase.

12. The marine motor assembly of claim 1, wherein the fluid conduit extends upwardly from the gearcase chamber to the housing chamber.

13. The marine motor assembly of claim 1, wherein the fluid conduit includes a gearcase section and a housing section, the gearcase section being a pipe extending in the gearcase, and the housing section being a channel defined in the upper housing portion.

14. The marine motor assembly of claim 1, wherein the housing chamber includes an inlet fluidly connected to the fluid conduit, and an outlet fluidly connected to the housing fluid port.

15. The marine motor assembly of claim 14, wherein the outlet is fluidly connected to the housing fluid port via a secondary fluid conduit extending generally downwardly from the housing chamber.

16. The marine motor assembly of claim 14, wherein the outlet is disposed vertically higher than a lower edge of all gears of the housing gearset when the marine motor assembly is in a neutral position.

17. The marine motor assembly of claim 14, wherein the outlet is spaced from a top of the housing chamber for providing clearance for a compressible gas.

18. The marine motor assembly of claim 1, wherein the gearcase chamber is fluidly sealed from a rest of the gearcase by a bracket.

19. The marine motor assembly of claim 1, further comprising:

a gearcase plug for selectively plugging the gearcase fluid port for preventing flow of fluid therethrough; and a housing plug for selectively plugging the housing fluid port for preventing flow of fluid therethrough.

* * * * *